US005112517A

United States Patent [19]

Buchwald et al.

[11] Patent Number: 5,112,517

[45] **Date of Patent: * May 12, 1992**

[54] CLEANING COMPOSITIONS COMPRISING DICHLOROTRIFLUOROETHANES AND ALKANOLS

[75] Inventors: Hans Buchwald, Ronnenberg; Andreas Brackmann, Hanover; Boleslaus Raschkowski, Wiedensahl, all of Fed. Rep. of Germany

[73] Assignee: Kalie-Chemie AG, Hanover, Fed. Rep. of Germany

[ * ] Notice: The portion of the term of this patent subsequent to May 19, 2009 has been disclaimed.

[21] Appl. No.: 550,975

[22] Filed: Jul. 11, 1990

[30] Foreign Application Priority Data

Jul. 27, 1989 [DE] Fed. Rep. of Germany ..... 3924889

[51] Int. Cl.[5] ..... C11D 7/50; C11D 7/30

[52] U.S. Cl. ..... 252/171; 252/162; 252/170; 252/DIG. 9

[58] Field of Search ..... 252/364, 162, 170, 171, 252/DIG. 9; 203/67; 134/12, 31, 38, 39, 40

[56] References Cited

U.S. PATENT DOCUMENTS

| | | | |
|---|---|---|---|
| 4,491,531 | 1/1985 | Bargigia et al. | 252/153 |
| 4,492,641 | 1/1985 | Buchwald et al. | 252/48.4 |
| 4,517,108 | 5/1985 | Hisamoto et al. | 252/162 |
| 4,812,256 | 3/1989 | Merchant et al. | 252/162 |

FOREIGN PATENT DOCUMENTS

| | | |
|---|---|---|
| 1248131 | 1/1989 | Canada . |
| 2817256 | 11/1978 | Fed. Rep. of Germany . |
| 3342852 | 6/1984 | Fed. Rep. of Germany . |
| 3335870 | 4/1985 | Fed. Rep. of Germany . |
| 1139539 | 11/1987 | Japan . |
| 1098699 | 4/1989 | Japan . |
| 136982 | 5/1989 | Japan . |
| 138300 | 5/1989 | Japan . |
| 139104 | 5/1989 | Japan . |
| 1139861 | 6/1989 | Japan . |
| 1152200 | 6/1989 | Japan . |
| 1574213 | 9/1980 | United Kingdom . |
| 1595887 | 8/1981 | United Kingdom . |
| 2084174 | 4/1982 | United Kingdom . |

*Primary Examiner*—Prince Willis, Jr.
*Assistant Examiner*—J. Silberman
*Attorney, Agent, or Firm*—Foley & Lardner

[57] ABSTRACT

Compositions composed of fluorochlorohydrocarbons selected from the group consisting of the dichlorotrifluoroethanes in admixture with lower alkanols. The compositions are especially suitable for use as cleaning compositions, particularly for removing organic resin fluxes or flux residues from printed circuit boards.

15 Claims, No Drawings

CLEANING COMPOSITIONS COMPRISING DICHLOROTRIFLUOROETHANES AND ALKANOLS

BACKGROUND OF THE INVENTION

The present invention relates to improved cleaning compositions composed of fluorochlorohydrocarbons selected from the group consisting of the dichlorotrifluoroethanes in admixture with alkanols, to the use of such cleaning compositions, and to methods for cleaning surfaces of articles using such compositions.

Very stringent requirements must be met by solvents used for cleaning purposes. Such solvents should have a relatively low boiling point, be non-flammable and substantially non-toxic and have a high solvent power for the impurities which are to be removed. However, as a rule, these requirements can not be met by a single, pure solvent. A large number of solvent mixtures having more or less widely differing compositions are therefore used in practice. Thus, besides using pure chlorinated and/or fluorinated hydrocarbons for industrial cleaning methods or for vapor degreasing, it is also generally known to use mixtures of fluorochlorohydrocarbons (as the principal solvent) with a co-solvent. Such mixtures can be either non-azeotropic or azeotropic or also azeotrope-like. As used herein, the term "azeotrope-like" indicates that a mixture has an essentially constant boiling point (variation of the boiling point by not more than 5° C.) over a fairly wide concentration range and therefore exhibits behavior similar to that of an azeotrope when used in practice.

Although many efforts have already been made in order to obtain cleaning compositions having the desired properties for various fields of use, the known mixtures still need improvement with regard to their technological, toxicological and environmental properties. Thus, for example as a result of further technical developments in the field of fluxes, new requirements have arisen for improved cleaning compositions which can remove newly developed fluxes. These requirements are not always met, or frequently are only met unsatisfactorily, by the known solvent mixtures. Other known solvent mixtures are multicomponent systems which have complicated compositions (for example, which require three or more essential solvent constituents) or contain major proportions of solvents which are objectionable for toxicological and/or safety reasons (low boiling point, low flash point). In the case of yet other solvent constituents, it is desirable for environmental reasons to replace them with other solvents which are at least equally suitable for the particular applications. Even today, there is therefore still a great need for new solvent mixtures which have new special properties, and which also are more acceptable from the toxicological and environmental points of view.

SUMMARY OF THE INVENTION

It is the object of the present invention to provide a new solvent mixture composition suitable for cleaning purposes.

It was also an object of the invention to provide a solvent mixture composition which is particularly suitable for removing soldering fluxes from printed circuit boards.

Another object of the invention is to provide a solvent mixture composition which at least partially overcomes the disadvantages of prior art compositions.

These and other objects of the invention are achieved by providing a composition comprising from 99.5% to 50.0% by weight of a fluorochlorohydrocarbon selected from the group consisting of the dichlorotrifluoroethanes, and 0.5% to 50.0% by weight of an alkanol having 2 or 3 carbon atoms, the total of the constituents being 100% by weight.

DETAILED DESCRIPTION OF PREFERRED EMBODIMENTS

The invention proposes novel compositions which are distinguished by a content of 99.5% to 50.0% by weight of a fluorochlorohydrocarbon selected from the group consisting of the dichlorotrifluoroethanes, and 0.5% to 50.0% by weight of an alkanol having 2 or 3 carbon atoms, the total of the constituents being 100% by weight.

In an advantageous sub-variant of the invention, the compositions are characterized in that they contain 99.5% to 65.0% by weight of the fluorochlorohydrocarbon selected from the group consisting of the dichlorotrifluoroethanes and 0.5% to 35.0% by weight of the alkanol, the total of the constituents being 100% by weight.

As used herein, the term "dichlorotrifluoroethanes" refers to fluorochlorohydrocarbons carrying one hydrogen atom and having the empirical formula $C_2HCl_2F_3$. These are thus the three not fully halogenated isomeric fluorochlorohydrocarbons 1,1-dichloro-2,2,2-trifluoroethane (=R 123), 1,2-dichloro-1,1,2-trifluoroethane (=R 123a) and 1,1-dichloro-1,2,2-trifluoroethane (=R 123b).

Compositions in which the dichlorotrifluoroethane is the 1,1-dichloro-2,2,2-trifluoroethane isomer (=R 123) are particularly preferred. However, compositions with the other isomers 1,2-dichloro-1,1,2-trifluoroethane (=R 123a) or 1,1-dichloro-1,2,2-trifluoroethane (=R 123b) are also very suitable.

The alkanols having 2 or 3 carbon atoms which are used in the composition of the invention are preferably selected from the group consisting of ethanol and isopropanol.

In particularly advantageous variants of the invention, the compositions contain the 1,1-dichloro-2,2,2-trifluoroethane isomer (=R 123) as the dichlorotrifluoroethane and are distinguished by an azeotrope-like or azeotropic behavior. Such azeotropic or azeotrope-like compositions of solvents have a number of advantages in use. On the one hand, they have a constant or essentially constant boiling point and, on the other hand, the composition of the mixtures then also remains constant or essentially constant. When azeotropic or azeotrope-like compositions are used, no fractionation of the solvent constituents of the compositions thus takes place, so that undesired changes in properties, such as, for example, a reduced solvent power, reduced inertness to the articles which are to be cleaned, or increased flammability when combustible co-solvents are used, are avoided. Furthermore, azeotropic or azeotrope-like compositions can readily be cleaned after use by an ordinary distillation and are thus available in a simple manner for further use, without the characteristics of the original composition being lost. It is not possible, however, to predict the formation of azeotropic or azeotrope-like compositions, which makes the search for novel azeotropic or azeotrope-like solvent systems more difficult.

It has now been found, according to the invention, that some compositions of 1,1-dichloro-2,2,2-trifluoroethane (=R 123) with small proportions (0.5% to 3.5% by weight) of a C2- or C3-alkanol show very narrow boiling ranges and thus behave like azeotropes.

One group of these special azeotrope-like compositions contains 99.5% to 98.0% by weight 1,1-dichloro-2,2,2--trifluoroethane (=R 123) in a mixture with 0.5% to 2.0% by weight ethanol. These compositions boil in the range from 27° to 31° C. at atmospheric pressure. The azeotropic composition with about 98.9% by weight 1,1-dichloro-2,2,2-trifluoroethane (=R 123) and 1.1% by weight ethanol, having a boiling point of about 27.1° C. at atmospheric pressure, is particularly advantageous.

Further specific azeotrope-like compositions contain 99.5% to 98.0% by weight 1,1-dichloro-2,2,2-trifluoroethane (=R 123) and 0.5% to 2.0% by weight isopropanol. These compositions boil in the range from 27.5° to 32° C. at atmospheric pressure. The azeotropic composition with about 99.0% by weight of 1,1-dichloro-2,2,2-trifluoroethane (=R 123) and 1.0% by weight of isopropanol, having a boiling point of about 27.7° C. at atmospheric pressure, is particularly advantageous.

It is surprising that despite their relatively small alkanol content, the azeotropic or azeotrope-like compositions of the invention have very good solvent power and show excellent cleaning properties. As a result, they are particularly suitable for many uses. The compositions according to the invention are solutions which are clear at room temperature and to which known additives can be added (the relative fluorochlorohydrocarbon/alkanol ratio, which is fixed by the above % by weight data, is not changed thereby).

One group of known additives are stabilizers. In this group are included those compounds which prevent undesired reactions of constituents of the composition with one another or with other reactants, such as, for example, atmospheric oxygen, metal, water and the like. Examples of known stabilizers include nitroalkanes, especially nitromethane and nitroethane; alkylene oxides, especially butylene oxide; or branched alkynols such as, for example, 2-methyl-3-butyn-2-ol. These stabilizers can be used alone or in combination with one another. Stabilizer quantities ranging from 0.01% to 5% by weight, preferably from 0.05% to 1% by weight, relative to the total mixture, are very suitable.

A further group of additives comprises known compounds selected from the group consisting of corrosion inhibitors, non-ionic or ionic emulsifiers, dyestuffs and the like.

The aforementioned compositions have numerous possible uses in the cleaning and/or vapor degreasing sectors. In these known methods, the article to be cleaned is dipped in one or more stages into a liquid and/or vaporous cleaning mixture or sprayed with a liquid cleaning mixture. In known methods, the cleaning effect can be enhanced by using the mixture at boiling temperature and/or by applying ultrasonic energy and/or by stirring. An improvement in the cleaning effect due to mechanical action such as, for example, brushing is likewise known.

For example, the electronics industry predominantly uses organic resin fluxes for soldering processes, and excess flux must be removed from printed circuit boards after the soldering step. This is accomplished by means of organic solvents which are compatible with the printed circuit boards and the electronic components, that is to say the solvent must not react with the circuit boards or electronic components. The resin fluxes which are to be removed are mixtures of polar and non-polar compounds and frequently additionally contain special activators. Fluorinated hydrocarbons alone, which are non-polar, are not effective for removing the polar components of the resin. Likewise, known mixtures which, in addition to fluorinated hydrocarbons, contain only an alcohol, are not able to completely remove fluxes, particularly special fluxes having high activator contents. State of the art solvent mixtures therefore frequently contain, in addition to the fluorinated hydrocarbon in the alcohol, further polar additives such as, for example, methyl acetate and the like, in order to provide these mixtures with sufficiently high solvent power even for polar components. Surprisingly, the dichlorotrifluoroethane and C2- to C3-alkanol compositions according to the invention are able to remove both the polar and the non-polar components, and they are therefore widely effective as removal agents for resin fluxes, in particular for those having a high activator content. The compositions with the 1,1-dichloro-2,2,2-trifluoroethane isomer (=R 123), especially the azeotrope-like compositions, are very particularly suitable for this application. However, other compositions of R 123 are also very useful, as are compositions according to the invention with the R 123a and R 123b isomers.

Thus, unloaded and loaded printed circuit boards (in particular also printed circuit boards loaded with surface-mounted devices) can be cleaned without any difficulty with the compositions according to the invention, even when fluxes having a high activator content are used, without the "white coatings" arising which are feared in the use of the conventional cleaning agents.

The novel compositions according to the invention are also desirable systems for coolants and lubricants, since the compositions have a low surface tension, a low viscosity and in most cases a suitably high density. The foregoing physical properties are desirable for lubricant applications. For example, the compositions according to the invention are advantageous if the mixture is used as a lubricant in metal-working machines, such as, for example, in drilling, milling, turning, thread cutting, punching or the like, where a residue-free surface is necessary. Known lubricant additives (such as are described, for example, in German published patent applications DE No. 3,342,852 and DE No. 3,335,870) can also be added for these uses.

The low surface tension, the high wetting capacity and the density of the compositions according to the invention make the latter particularly suitable for cleaning capillary systems.

The compositions according to the invention can, for example, also be used for cleaning small components or loose material (preferably in closed units), for paint stripping, and/or as a special solvent, extractant and/or recrystallization medium in the chemical and pharmaceutical industries.

The cleaning compositions according to the invention, composed of not fully halogenated fluorochlorohydrocarbons selected from the group of the dichlorotrifluoroethanes, which contain C2- to C3-alkanol as a co-solvent, ensure to a high degree the high purity which is required in special fields of use, for example in cleaning components and printed circuit boards in the electronics industry. Their properties are superior to those of previously known mixtures of fully halogenated fluorochlorohydrocarbons and alcohols and, furthermore, are also not inferior to state of the art ternary compositions composed of fully halogenated fluorochlorohydrocarbons, alcohol and further polar additives such as, for example, methyl acetate. It is here all the more surprising that the novel binary mixtures according to the invention which do not contain any further essential polar additives to increase the solvent power in addition to the dichlorotrifluoroethane solvent and the alkanol, show excellent cleaning properties and are very highly suitable for such applications. The compositions according to the invention facilitate novel problem solutions in a wide field of applications. It is also advantageous that the not fully halogenated fluorochlorohydrocarbon solvents which are used are more easily degraded and thus exhibit better environmental compatibility than the fully halogenated fluorochlorohydrocarbons.

The following examples are intended to illustrate the invention in further detail without, however, limiting the scope thereof. Unless otherwise stated, percents refer to percent by weight.

EXAMPLE 1

Cleaning of printed circuit boards

Cleaning tests were carried out in a commercially available 2-chamber or 3-chamber cleaning unit on printed circuit boards which were contaminated either with a conventional halogen-containing soldering flux (Test Nos. 2 and 3) or with soldering fluxes of high activator content (Test Nos. 1, 4 and 5). The cleaning compositions, cleaning conditions and cleaning results are reproduced in the following Table 1.

TABLE 1

| No | Composition of Bath 1 | Cleaning Conditions | Result |
|---|---|---|---|
| 1 | R 123/ethanol 65.0%/35.0% | 3 baths: 1) 3 min ultrasonic 2) 1 min ultrasonic 3) 1 min vapor degreasing (in baths 2 and 3: R123) | + + |
| 2 | R 123/isopropanol 99.5%/0.5% | 2 baths: 1) 3 min ultrasonic 2) 1 min vapor degreasing (bath 2 same as bath 1) | + + |
| 3 | R 123/ethanol 99.5%/0.5% | 2 baths: 1) 3 min ultrasonic 2) 1 min vapor degreasing (bath 2 same as bath 1) | + + |
| 4 | R 123/isopropanol 99.0%/1.0% | 2 baths: 1) 3 min ultrasonic 2) 1 min vapor degreasing (bath 2 same as bath 1) | + + |
| 5 | R 123/ethanol | 2 baths: 1) 3 min ultrasonic 2) 1 min vapor degreasing (bath 2 same as bath 1) | + + |

In the cases marked "+ +" in the "results" column, a very good cleaning effect was achieved and there was no formation of "white coatings". It can be clearly seen that the compositions according to the invention exhibit excellent cleaning performance.

EXAMPLE 2

Cleaning of loose material

Loose material (transistor caps) were cleaned in a two chamber unit (3 minutes ultrasonics, 1 minute vapor degreasing) with an azeotropic mixture of 99.0% of R 123 and 1.0% of isopropanol in order to remove drawing oils. After the treatment, the loose material was perfectly clean.

Analogously to Example 2, loose material was cleaned with azeotropic mixtures of 98.9% of R 123 and 1.1% of ethanol. After the treatment, the loose material was likewise perfectly clean.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all variations falling within the ambit of the appended claims and equivalents thereof.

What is claimed is:

1. A composition of matter which consists essentially of an azeotrope-like binary solvent mixture having a boiling point range of from 27° C. to 31° C. at atmospheric pressure and consisting essentially of from 99.5% to 98.0% by weight 1,1-dichloro-2,2,2-trifluoroethane (=R 123) and from 0.5% to 2.0% by weight ethanol, the total of the constituents being 100% by weight.

2. A composition according to claim 1, which is an azeotropic composition consisting essentially of 98.9% by weight 1,1-dichloro-2,2,2-trifluoroethane (=R 123) and 1.1% by weight ethanol, having a boiling point of about 27.1° C. at atmospheric pressure.

3. A composition of matter consisting essentially of:

100 parts by weight of a binary solvent mixture which is an azeotropic-like composition having a boiling point in the range from 27° C. to 31° C. at atmospheric pressure and consisting essentially of from 99.5 to 98 parts by weight of 1,1-dichloro-2,2,2-trifluoroethane (=R 123) and from 0.5 to 2 parts by weight ethanol, for a total of 100 parts by weight; and optionally from 0 to 5 parts by weight of additives selected from the group consisting of stabilizers, corrosion inhibitors, non-ionic or ionic emulsifiers, and dyestuffs.

4. A composition according to claim 3, wherein said binary solvent mixture is an azeotropic composition consisting of approximately 98.9 parts by weight 1,1-dichloro-2,2,2-trifluoroethane (=R 123) and 1.1 parts by weight ethanol, having a boiling point of about 27.1° C. at atmospheric pressure.

5. A composition according to claim 3, further comprising from 0.01% to 5% by weight of a stabilizer.

6. A composition according to claim 5, comprising from 0.05% to 1% by weight of said stabilizer.

7. A composition according to claim 5, wherein said stabilizer is selected from the group consisting of nitroalkanes, alkylene oxides, alkynols and mixtures thereof.

8. A composition of matter which consists essentially of an azeotrope-like binary solvent mixture having a boiling point range of from 27.5° to 32° C. at atmospheric pressure and consisting essentially of 99.5% to 98.0% by weight 1,1-dichloro-2,2,2-trifluoroethane (=R 123) and 0.5% to 2.0% by weight isopropanol.

9. A composition according to claim 8, which is an azeotropic composition consisting essentially of 99.0% by weight 1,1-dichloro-2,2,2-trifluoroethane (=R 123) and 1.0% by weight isopropanol, having a boiling point of about 27.7° C. at atmospheric pressure.

10. A composition of matter consisting essentially of:

100 parts by weight of a binary solvent mixture which is an azeotropic-like composition having a boiling point range of from 27.5° C. to 32° C. at atmospheric pressure and consisting essentially of from 99.5 to 98 parts by weight 1,1-dichloro-2,2,2-trifluoroethane (=R 123) and from 0.5 to 2 parts by weight isopropanol, for a total of 100 parts by weight; and optionally from 0 to 5 parts by weight of additives selected from the group consisting of stabilizers, corrosion inhibitors, non-ionic or ionic emulsifiers, and dyestuffs.

11. A composition according to claim 10, wherein said binary solvent mixture is an azeotropic composition consisting of approximately 99 parts by weight 1,1-dichloro-2,2,2-trifluoroethane (=R 123) and 1 part by weight isopropanol, having a boiling point of about 27.7° C. at atmospheric pressure.

12. A composition according to claim 10, further comprising from 0.01% to 5% by weight of a stabilizer.

13. A composition according to claim 12, comprising from 0.05% to 1% by weight of said stabilizer.

14. A composition according to claim 12, wherein said stabilizer is selected from the group consisting of nitroalkanes, alkylene oxides, alkynols and mixtures thereof.

15. A method of cleaning comprising contacting an article to be cleaned with a composition consisting essentially of:

100 parts by weight of an azeotropic-like binary solvent mixture having a boiling point range of from 27° C. to 32° C. at atmospheric pressure and consisting essentially of:

from 99.5 to 96.5 parts by weight of dichlorotrifluoroethane, and from 0.5 to 3.5 parts by weight of ethanol or isopropanol;

and optionally from 0 to 5 parts by weight of additives selected from the group consisting of stabilizers, corrosion inhibitors, non-ionic or ionic emulsifiers, and dyestuffs;

wherein the article to be cleaned is a printed circuit board contaminated with soldering flux or soldering flux residues.

* * * * *